US012054845B2

(12) United States Patent
Tripathy

(10) Patent No.: US 12,054,845 B2
(45) Date of Patent: Aug. 6, 2024

(54) METAL COATED ARTICLES COMPRISING A REFRACTORY METAL REGION AND A PLATINUM-GROUP METAL REGION, AND RELATED METHODS

(71) Applicant: Battelle Energy Alliance, LLC, Idaho Falls, ID (US)

(72) Inventor: Prabhat K. Tripathy, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 0 days.

(21) Appl. No.: 18/069,386

(22) Filed: Dec. 21, 2022

(65) Prior Publication Data

US 2023/0193500 A1 Jun. 22, 2023

Related U.S. Application Data

(60) Provisional application No. 63/292,105, filed on Dec. 21, 2021.

(51) Int. Cl.
*C25D 5/10* (2006.01)
*C25D 5/50* (2006.01)

(52) U.S. Cl.
CPC ..... *C25D 5/10* (2013.01); *C25D 5/50* (2013.01); *Y10T 428/12875* (2015.01)

(58) Field of Classification Search
None
See application file for complete search history.

(56) References Cited

U.S. PATENT DOCUMENTS 5,436,505 A * 7/1995 Hayashi ..... H01L 29/45 438/653
5,500,248 A * 3/1996 Iacovangelo ..... C23C 14/5893 427/249.8
5,929,523 A * 7/1999 Parsons ..... H01L 24/01 257/77
6,388,272 B1 * 5/2002 Odekirk ..... H01L 29/6606 438/575
2010/0206941 A1 * 8/2010 Egan ..... C09K 3/1445 427/249.1
2015/0102266 A1 * 4/2015 Bitziou ..... G01N 27/308 252/502
2020/0048776 A1 2/2020 Wei et al.

FOREIGN PATENT DOCUMENTS

CN 207646292 U 7/2018
JP 2004244306 A * 9/2004 ..... C03B 11/086
WO WO-9705757 A1 * 2/1997 ..... B23K 1/0016

OTHER PUBLICATIONS

Novoselova et al., Diamond Electrodes in Ionic Melts: Fundamental Results and Application, Sustainable Industrial Processing Summit/ Shechtman International Symposium, vol. 6, Ionic Salt, Rare Earth, (2014), 17 pages.

* cited by examiner

*Primary Examiner* — Seth Dumbris
(74) *Attorney, Agent, or Firm* — TraskBritt

(57) ABSTRACT

A metal coated article includes a platinum-group metal region adjacent a refractory metal region, which is adjacent a substrate comprising an inorganic material. A refractory metal carbide layer is adjacent the substrate and the refractory metal layer is adjacent the refractory metal carbide layer. The platinum-group metal region comprises a refractory metal/platinum-group metal layer and a platinum-group metal layer. Related methods are also disclosed.

20 Claims, 2 Drawing Sheets

METAL COATED ARTICLES COMPRISING A REFRACTORY METAL REGION AND A PLATINUM-GROUP METAL REGION, AND RELATED METHODS

CROSS-REFERENCE TO RELATED APPLICATION

This application claims the benefit under 35 U.S.C. § 119(e) of U.S. Provisional Patent Application Ser. No. 63/292,105, filed Dec. 21, 2021, the disclosure of which is hereby incorporated herein in its entirety by this reference.

STATEMENT REGARDING FEDERALLY SPONSORED RESEARCH OR DEVELOPMENT

This invention was made with government support under Contract Number DE-AC07-05-ID14517 awarded by the United States Department of Energy. The government has certain rights in the invention.

TECHNICAL FIELD

The disclosure relates generally to electrodeposition using molten salt electrochemistry and coated articles produced thereby. Specifically, the disclosure relates to forming an inert functional anode and other metal coated articles, by electroplating a refractory metal region on a substrate, and by electroplating a platinum-group metal region onto the refractory metal region, to produce a coated metal article. Also, the disclosure relates to electrorefining binary ore concentrates, by use of a disclosed inert functionalized anode.

BACKGROUND

Some uses of coated, boron-doped diamond articles may be subjected to elevated temperatures that may be extreme to the boron-doped diamond materials, such that degradation of bodily integrity may occur, and the boron-doped diamond materials may fail a given intended purpose. Oxidizing conditions such as the presence of oxygen or other oxidizing compounds, may hasten the degradation of the boron-doped diamond materials.

BRIEF SUMMARY

Embodiments of the disclosure are directed to a metal coated article, comprising a platinum-group metal coating region adjacent a refractory metal region, which is adjacent a substrate. The refractory metal region may include a refractory metal carbide layer that is adjacent the substrate. The platinum-group metal region includes a platinum-group metal layer and a refractory metal/platinum-group metal layer.

Also disclosed is a method of forming a metal coated article that comprises forming a refractory metal region on a boron-doped diamond substrate. A refractory metal is deposited from a functional electrolyte in an alkali halide auxiliary electrolyte bath, onto the boron-doped diamond substrate to form a refractory metal layer. A portion of the refractory metal layer is converted to a refractory metal carbide layer while a portion of the refractory metal layer remains an unreacted refractory metal, the refractory metal layer on the refractory metal carbide layer. A platinum-group metal region is formed on the refractory metal region and comprises depositing a platinum-group metal from a functional electrolyte in an alkali halide auxiliary electrolyte bath, onto the refractory metal layer to form a platinum-group metal layer and converting a portion of the platinum-group metal layer to a platinum-group metal, refractory metal transition layer between the platinum-group metal layer and the refractory metal layer. The platinum-group metal layer comprises an exterior coating of the metal coated article.

A method of forming an alloy is also disclosed. An ilmenite concentrate ($FeO{\cdot}TiO_2$) is immersed in an electrolytic system that comprises a crucible, a metal salt electrolyte in the crucible, a working electrode (the ilmenite) immersed in the metal salt electrolyte, a reference electrode immersed in the metal salt electrolyte, and a counter electrode immersed in the metal salt electrolyte. The counter electrode comprises a boron-doped diamond substrate, a refractory metal carbide layer on the boron-doped diamond substrate, a refractory metal layer on the refractory metal carbide layer, and a platinum-group layer on a platinum-group metal/refractory metal layer and on the refractory metal carbide layer. A voltage and a current are applied between the working electrode and the reference electrode to convert the ilmenite to an iron-titanium alloy on a substrate connected to the working electrode.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

DETAILED DESCRIPTION

Figure 1:
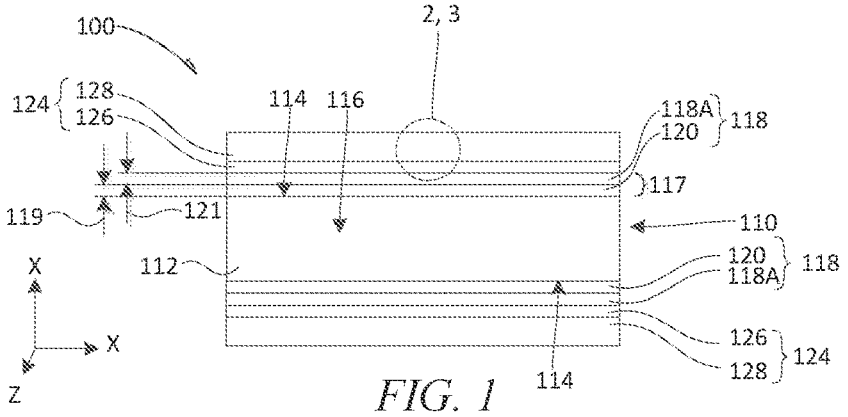
FIG. 1 is a simplified transverse cross-section view of a functionalized inert electrode in accordance with one or more embodiments of the disclosure.

Metal coated articles are disclosed that may be configured as functionalized inert anodes. A "functionalized" inert anode may include a coated substrate, where thermal conductivity and electrical conductivity are improved relative to a substrate lacking the coating, along with corrosion-resistant qualities that have been added to further functionalize the coated substrate. The metal coated article may include a substrate, a refractory metal region on the substrate, and a platinum-group metal (PGM) region on the refractory metal region. The metal coated article may, for example, have a boron-doped diamond (BDD) substrate that is coated with the refractory metal region and the PGM region. The refractory metal region may be annealed to form a refractory metal carbide layer between the substrate and a refractory metal layer. The PGM region is coated on the refractory metal region as an outer coating, and may contain a refractory metal/PGM layer between a PGM layer and the refractory metal layer. The refractory metal region, including the refractory metal layer and the refractory metal carbide layer, increases electrical conductivity of the metal coated article. The PGM region provides chemical inertness in the presence of corrosive environments, such as in the presence of oxygen, that protects the BDD substrate from corrosion and oxidation, particularly at usage temperatures higher than the 500° C. to 550° C. range. Such functionalized electrodes and coated articles provide twin goals of lessening carbon footprints while maintaining usual production cycles.

An electrodeposition coating process (also known as electroplating) may be used to form (e.g., deposit) high-quality, smooth, well-adhered, and thick metallic films (e.g., metallic and metal carbide structures as coatings) on a variety of thermally conductive substrate materials (e.g., substrates, that may be used for inert anode bodies). The electrodeposition process utilizes a combination of an alkali metal-based molten salt electrolyte (e.g., an auxiliary electrolyte) and a functional electrolyte (of the metal(s) of interest), each metal of which is in turn coated onto the substrate at a temperature in a range of about 350° C. to about 950° C. In some embodiments, deposition temperatures are in a range from about 350° C. to about 500° C.

Electrochemical processing of metals dissolved in the auxiliary electrolyte, include first electrochemical processing a refractory metal from a refractory metal functional electrolyte, onto the substrate, followed by, after some other processing, second electrochemical processing a platinum-group metal from a platinum-group metal functional electrolyte. Between forming the refractory metal and forming the platinum-group metal, an anneal process may be done to form the refractory metal carbide with materials from the substrate.

The following description provides specific details, such as material compositions and processing conditions (e.g., temperatures, current densities, etc.) in order to provide a thorough description of embodiments of the disclosure. However, a person of ordinary skill in the art will understand that the embodiments of the disclosure may be practiced without necessarily employing these specific details. Indeed, the embodiments of the disclosure may be practiced in conjunction with conventional systems and methods employed in the industry. In addition, only those process components and acts necessary to understand the embodiments of the disclosure are described in detail below. A person of ordinary skill in the art will understand that some process components (e.g., valves, temperature detectors, flow detectors, pressure detectors, and the like) are inherently disclosed herein and that adding various conventional process components and acts would be in accord with the disclosure.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figure. Unless otherwise specified, the spatially relative terms are intended to encompass different orientations of the materials in addition to the orientation depicted in the figure. For example, if materials in the figure are inverted, elements described as "below" or "beneath" or "under" or "on bottom of" other elements or features would then be oriented "above" or "on top of" the other elements or features. Thus, the term "below" may encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, "and/or" includes any and all combinations of one or more of the associated listed items.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, the term "substantially all" means and includes greater than about 95%, such as greater than about 99%.

As used herein, the term "about" in reference to a numerical value for a particular parameter is inclusive of the numerical value and a degree of variance from the numerical value that one of ordinary skill in the art would understand is within acceptable tolerances for the particular parameter. For example, "about" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof.

As used herein, the term "may" with respect to a material, structure, feature or method act indicates that such is contemplated for use in implementation of some embodiments of the disclosure and such term is used in preference to the more restrictive term "is" so as to avoid any implication that other, compatible materials, structures, features and methods usable in combination therewith should or must be excluded.

As used herein, the term "anode" and its grammatical equivalents means and includes an electrode where oxidation takes place.

As used herein, the term "cathode" and its grammatical equivalents means and includes an electrode where reduction takes place.

The illustrations presented herein are not meant to be actual views of any particular setup, or related method, but are merely idealized representations, which are employed to describe example embodiments of the disclosure. The figures are not necessarily drawn to scale. Additionally, elements common between figures may retain the same numerical designation.

FIG. 1 is a simplified transverse cross-section view of a functionalized inert electrode 100 in accordance with one or more embodiments of the disclosure. The functionalized inert electrode 100 may also be referred to as a metal-coated article 100 where usage may be employed for purposes other than a functionalized electrode, the other uses may be such as a molten salt reactor wall, an x-ray anode, or such as a reactor structure for use under high-temperature corrosive-conditions. A substrate 110 (also referred to as a "body region") is coated with a refractory metal region 118, which in turn is coated with a platinum-group metal region 124.

The substrate 110 may be an inorganic material including, but not limited to, a boron-doped diamond (BDD) material, a molybdenum disilicide ($Mo_xSi_y$) material, a graphite material, a lanthanum chromite ($La_xCr_yO_3$)-based materials, a perovskite material, such as $FeTiO_3$, a titanium material, such as one of rutile or anatase morphologies of $TiO_2$, or a combination thereof. Hereinafter unless explicitly disclosed otherwise, the substrate 110 will be referred to as a BDD substrate 110. It is understood, however, that any of the above enumerated substrate materials may be used, among other materials useful as thermally conductive bodies for use in molten salt reactors and other uses. In some embodiments where the BDD substrate 110 is used, a synthetic diamond material is prepared as the BDD substrate 110.

Still referring to FIG. 1, the BDD substrate 110 may have a boron content that is substantially uniformly distributed throughout the BDD substrate 110, a boron content that is concentrated closer to surface locations 114 of the BDD substrate 110 than to centroid locations 116 thereof, or a boron content that is more concentrated closer to the centroid locations 116 than to the surface locations 114. In other words, the BDD substrate 110 may include a homogeneous composition of the boron-doped diamond or a heterogeneous composition of the boron-doped diamond. Regardless of the boron-content concentrations and distributions within the BDD substrate 110, the BDD substrate 110 consists of or consists essentially of the boron-doped diamond material. Surface locations 114 on the body section first structure 112, define lateral (X-direction) boundaries of the BDD substrate 110.

The metal-coated article 100 may be formed by electrochemical processing (e.g., electroplating) onto and over (e.g., above) the BDD substrate 110 in two deposition acts: first, to form the refractory metal region 118 on the BDD substrate 110, and second, to form the platinum-group metal region 124 on the refractory metal region 118. Electrochemical processing is done by an alkali halide salt melt process, where an auxiliary electrolyte provides a thermodynamic and kinetic pathway for a metal in the functional electrolyte to deposit onto the BDD substrate 110 in an electrochemical processing system. In some embodiments, the functional electrolyte may make up a portion of a volume of the salt melt, such as in a range from about 60 weight percent (wt. %) to about 90 wt. %. In some embodiments, the functional electrolyte makes up from at least about 60 wt. % to about 80 wt. % of the salt melt. The auxiliary electrolyte may account for from about 10 wt. % to about 40 wt. % of the salt melt. The salt melt may, for example, include only the auxiliary electrolyte and the functional electrolyte.

An annealing act is done before electrochemical processing the platinum-group metal region 124 on the refractory metal region 118, where the annealing act converts some refractory metal of the refractory metal region 118 to a refractory metal carbide layer 120 between the BDD substrate 110, and unconverted refractory metal layer 118A of the refractory metal region 118. The refractory metal carbide layer 120 directly contacts the BDD substrate 110 and the unconverted refractory metal layer 118A. The refractory metal carbide layer 120 exhibits characteristics (e.g., properties) of each of the body section first structure 112 and the unconverted refractory metal layer 118A. Such properties may be achieved by annealing techniques under sufficient temperature, time and environmental conditions to achieve the refractory metal carbide layer 120. In general, where the body section first structure 112 includes any of the enumerated body section materials, the annealing act results in converting some of the refractory metal region 118 to a second, refractory metal carbide layer 120 between the BDD materials of the body section first structure 112 and remaining, unconverted refractory metal that becomes an unconverted refractory metal layer 118A. Thereafter, the platinum-group metal region 124 is plated over the refractory metal region.

The refractory metal region 118 may be formed of at least one selected refractory metal, where the auxiliary electrolyte is formed in the alkali metal salt melt and the functional electrolyte includes the selected refractory metal material. The refractory metal may include, but is not limited to, tungsten, vanadium, molybdenum, titanium, or a combination thereof. Formation of the plated refractory metal material may be done in an inert (e.g., non-reactive) atmosphere, e.g., argon or helium. The inert atmosphere allows the material of the refractory metal region 118 to cool after deposition without getting oxidized. Formation of the unconverted refractory metal layer 118A and the refractory metal carbide layer 120 includes first electroplating a refractory metal from the refractory metal functional electrolyte to form the refractory metal region 118, which after annealing, includes the refractory metal carbide layer 120, and unreacted refractory metal material of the unconverted refractory metal layer 118A.

The refractory metal carbide layer 120 transitions in chemical composition to the unconverted refractory metal layer 118A. The refractory metal carbide layer 120 includes carbon from the BDD substrate 110 and the refractory metal element from the refractory metal region 118, with varying relative amounts of carbon and refractory metal. The refractory metal carbide layer 120 may include compounds of carbon and the refractory metal, such as stoichiometric compounds or non-stoichiometric compounds of carbon and the refractory metal. Alternatively, the refractory metal carbide layer 120 may include a gradient of carbon in a layer of the refractory metal. More particularly, the refractory metal region 118 may include the refractory metal carbide layer 120 adjacent the body section first structure 112 of the BDD substrate 110 beginning at the surface locations 114. In some embodiments, the unconverted refractory metal layer 118A is adjacent to the refractory metal carbide layer 120 and is an unreacted refractory metal that is a structural and material transition from the refractory metal carbide layer 120.

Still referring to FIG. 1, formation of the refractory metal region 118 on the BDD substrate 110, may include using an alkali metal bromide electrochemical processing bath melt, where the refractory metal is dissolved as the functional electrolyte in the bromide electrochemical processing bath. The alkali metal bromide electrochemical processing bath may include, but is not limited to, a lithium bromide melt, a potassium bromide melt, a cesium bromide melt, or a combination thereof. Alternatively, an alkali metal chloride melt or an alkali metal fluoride melt may be used to dissolve and plate the refractory metal.

Functional electrolytes for the refractory metal region 118 may include a tungsten-containing metal functional electrolyte in the alkali metal bromide melt, a molybdenum-containing metal functional electrolyte, a vanadium-containing metal functional electrolyte, or a titanium-containing material functional electrolyte.

Processing follows, to anneal the refractory metal region 118, such that the refractory metal carbide layer 120 is formed adjacent the body section first structure 112, beginning from the surface locations 114. In some embodiments, anneal conditions include heating to a temperature range from about 500° C. to about 600° C., for a time period from about 1 hour, up to about 10 hours, and in an inert-gas environment such as with helium (He) or argon (Ar). In other embodiments, the anneal conditions include heating to a temperature range from about 500° C. to about 600° C., for a time period from about 1 hour to about 12 hours, and in an inert-gas environment such as with helium (He) or argon (Ar).

Still referring to FIG. 1, the unconverted refractory metal layer 118A is adjacent the refractory metal carbide layer 120. In some embodiments, the anneal conditions achieve a thickness ratio (taken in the X-direction) where the thickness of the refractory metal carbide layer 120 is thicker (X-direction) than the thickness (X-direction) of the unconverted refractory metal layer 118A by a ratio of about 3:1. Put another way, the refractory metal region 118 has refractory metal carbide layer 120 with a thickness 119 that is about three-fourths the total thickness of the refractory metal region 118, and where the unconverted refractory metal layer 118A has a thickness 121 that is about one-fourth (or the remainder) of the refractory metal region 118. In some embodiments, refractory metal region 118 has an overall thickness (X-direction) in a range from about 10 micrometer (μm) to about 20 μm, and the refractory metal carbide layer 120 is relatively thicker than the unconverted refractory metal layer 118A, in a range including a majority amount thicker, up to the above-given ratios of 3:1.

Following the anneal, the refractory metal carbide layer 120 may have formed a functionalized bond to the body section first structure 112, such that physical integrity of the unconverted refractory metal layer 118A is maintained above the body section first structure 112 during usage such as molten salt deposition processing, where the metal-coated article 100 is an inert anode. Further, achievement of the refractory metal carbide layer 120, improves electrical conductivity when the metal-coated article 100 is used as an inert anode.

Still referring to FIG. 1, the metal-coated article 100 includes the platinum-group metal (PGM) coating region 124 over (e.g., above) the refractory metal region 118. In some embodiments, the PGM coating region 124 includes a platinum-group metal layer 128 above the unconverted refractory metal layer 118A. The PGM layer (fifth structure) 128 may function as an outer coating for the metal-coated article 100. A refractory metal/platinum-group metal layer 126 is a metal-metal transition between and contacting at opposite boundaries, the platinum-group metal layer 128 and the unconverted refractory metal layer 118A. The refractory metal/platinum-group metal layer 126 is a metal-metal structure, and includes a chemical composition that transitions between the composition of the refractory metal 122 and the composition of the platinum-group metal layer 128. The refractory metal/platinum-group metal layer 126 may include a homogeneous composition of the refractory metal and the platinum-group metal or a heterogeneous composition of the refractory metal and the platinum-group metal, such as a gradient. In some embodiments, the platinum-group metal region 124 is formed using a ruthenium-containing material functional electrolyte in an alkali metal bromide melt, an iridium-containing material functional electrolyte in an alkali metal bromide melt, or a platinum-containing material functional electrolyte in an alkali metal bromide melt.

Still referring to FIG. 1, adhesion of the PGM coating region 124 to the refractory metal region 118, may be achieved under second annealing conditions that result in a transition in chemical composition of the refractory metal/platinum-group metal layer 126 on the unconverted refractory metal layer 118A. Further, achievement of the platinum-group metal layer 128, provides functionalized corrosion resistance in oxidizing environments such as oxygen-exposed molten salt electrochemical processing. Further, the platinum-group metal layer 128, also protects the refractory metal region 118 from the degradation thereof, due to the presence of oxygen during the molten salt electrochemical processing. Electroplating process is used to fabricate the anode, which is exposed to oxygen during the electrochemical reduction of metal oxides to metals/alloys where the anode gets exposed to an oxidizing environment containing significant amounts of oxygen in molten salts.

The following Examples may be referred to as embodiments related to the metal-coated article 100 illustrated in FIG. 1. These Example embodiments, however, are not limiting to other embodiments within the scope of the disclosure. In the following Example embodiments, a BDD substrate 110 may be used, or it may be substituted by one of other enumerated materials, including one of molybdenum disilicide, graphite, lanthanum chromite-based materials, a perovskite material, and a titanium material. Processing conditions include forming each of the refractory metal region 118 and the PGM coating region 124 in molten salt auxiliary electrolyte baths in the inert atmosphere and at a temperature ranging from about 350° C. to about 500° C.

In each of the following Example embodiments, the refractory metal region 118 may include one of a tungsten-containing material, a molybdenum-containing material, a vanadium-containing material, and a titanium-containing material. In the following Example embodiments, after formation of the refractory metal region 118, an annealing process is done to form the refractory metal carbide layer 120 beginning from the surface locations 114 of the body section first structure 112 of the BDD substrate 110.

Example 1: The PGM coating region 124 is formed over the refractory metal region 118, from ruthenium (Ru), where the PGM layer 128 includes Ru, and where the refractory metal/platinum-group metal layer 126 may be at least partially a transition of the unconverted refractory metal layer 118A and Ru.

Example 2: The PGM coating region 124 is formed over the refractory metal region 118, from iridium (Ir), where the PGM layer 128 includes Ir, and where the refractory metal/platinum-group metal layer 126 may be at least partially a transition of the unconverted refractory metal layer 118A and Ir.

Example 3: The PGM coating region 124 is formed over the refractory metal region 118, from platinum (Pt), where the PGM layer 128 includes Pt, and where the refractory metal/platinum-group metal layer 126 may be at least partially a transition of the unconverted refractory metal layer 118A and Pt.

For Examples 1, 2 and 3, where adhesion of a pre-annealed refractory metal region 118 that includes a refractory metal precursor layer 117 is sufficient to sustain subsequent formation of the PGM coating region 124, annealing may be done after forming the PGM coating region 124, whereby the refractory metal carbide layer 120 is formed.

Figure 2:
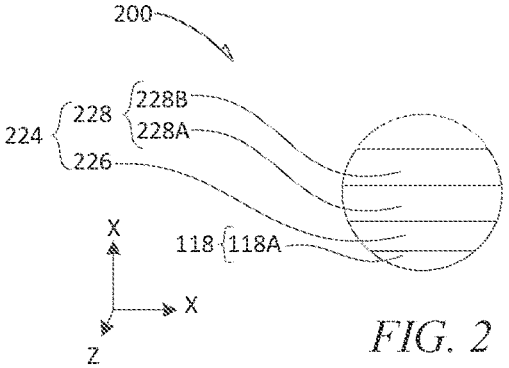
FIG. 2 is a detail section that is taken from a location indicated by the dashed circle illustrated in FIG. 1 in accordance with one or more embodiments of the disclosure.

FIG. 2 is a detail section that is taken from a location indicated by the dashed circle illustrated in FIG. 1 in accordance with one or more embodiments of the disclosure. In contrast to the single platinum-group metal layer 128 illustrated in FIG. 1, two layers of platinum-group metals 228A, 228B are present. Electrochemical processing of a PGM coating region 224 includes sequential electrochemical processing of two layers of platinum-group metals. A portion of a metal-coated article 200 is illustrated, including some of a refractory metal region 118 (e.g., FIG. 1), including an unconverted refractory metal layer 118A. Further, the PGM coating region 224 includes a refractory metal/platinum-group metal layer 226, which exhibits a chemical composition that transitions between the refractory metal region 118 and the PGM coating region 224.

Still referring to FIG. 2, the PGM coating region 224 may be sequentially formed of more than one platinum-group metal, where a PGM section 228 may include, for example, two platinum-group metals sequentially deposited, and where the refractory metal/platinum-group metal layer 226 may be at least partially a transition of a first-plated platinum-group metal. Consequently, the PGM section 228 may include a PGM section layer 228A and a PGM section layer 228B above and on the PGM section layer 228A.

Still referring to FIG. 2, sequential electrochemical processing of PGM metals to form the PGM coating region 224, may be done in a single auxiliary electrolyte-containing electrochemical processing bath, where metal contained in a first PGM functional electrolyte is substantially deposited onto the refractory metal region 118 and depleted from the salt melt electrochemical processing bath, followed by adding a second PGM functional electrolyte containing a metal to deposit a second PGM layer. In some embodiments, two separate salt melt electrochemical processing baths may be used where a first electrochemical processing bath includes an auxiliary electrochemical processing bath and a first PGM functional electrolyte, followed by a second electrochemical processing bath including an auxiliary electrolyte and a second PGM functional electrolyte.

Example 4: Still referring to FIG. 2, a sequential electrochemical processing is formed over the refractory metal region 118, by forming a PGM coating region 224 with two layers of platinum-group metals 228A, 228B, with a platinum (Pt) layer, followed by an iridium (Ir) layer to form the PGM coating region 224, where at least a portion of the platinum (Pt) layer forms at least some of the transition structure of the refractory metal/platinum-group metal layer 226.

Example 5: Still referring to FIG. 2, a sequential electrochemical processing is formed over the refractory metal region 118, by forming a PGM coating region 224 with two layers of platinum-group metals 228A, 228B, including an iridium (Ir) layer, followed by a platinum (Pt) layer to form the PGM coating region 224, where at least a portion of the iridium layer forms at least some of the transition structure of the refractory metal/platinum-group metal layer 226.

Example 6: Still referring to FIG. 2, a sequential electrochemical processing is formed over the refractory metal region 118, by forming a PGM coating region 224 with two layers of platinum-group metals 228A, 228B, including a platinum (Pt) layer, followed by a ruthenium (Ru) layer to form the PGM coating region 224, where at least a portion of the Pt layer forms the transition structure of the refractory metal/platinum-group metal layer 226.

Example 7: Still referring to FIG. 2, a sequential electrochemical processing is formed over the refractory metal region 118, by forming a PGM coating region 224 with two layers of platinum-group metals 228A, 228B, including a ruthenium (Ru) layer, followed by an iridium (Ir) layer to form the PGM coating region 224, where at least a portion of the Ru layer forms the transition structure of the refractory metal/platinum-group metal layer 226.

Example 8: Still referring to FIG. 2, a sequential electrochemical processing is formed over the refractory metal region 118, by forming a PGM coating region 224 with two layers of platinum-group metals 228A, 228B, including a ruthenium (Ru) layer, followed by a platinum (Pt) layer to form the PGM coating region 224, where at least a portion of the Ru layer forms the transition structure of the refractory metal/platinum-group metal layer 226.

Example 9: Still referring to FIG. 2, a sequential electrochemical processing is formed over the refractory metal region 118, by forming a PGM coating region 224 with two layers 228A, 228B of platinum-group metals, with an iridium (Ir) layer, followed by a ruthenium (Ru) layer, to form the PGM coating region 224, where at least a portion of the Ir layer forms the transition structure of the refractory metal/platinum-group metal layer 226.

For Examples 4-9, where adhesion of a pre-annealed refractory metal region 118 that includes the refractory metal precursor section 117 (e.g., FIG. 1) is sufficient to sustain subsequent formation of the PGM coating region 224, annealing may be done after forming the PGM coating region 224, whereby the refractory metal carbide layer 120 (e.g., FIG. 1) is formed.

Figure 3:
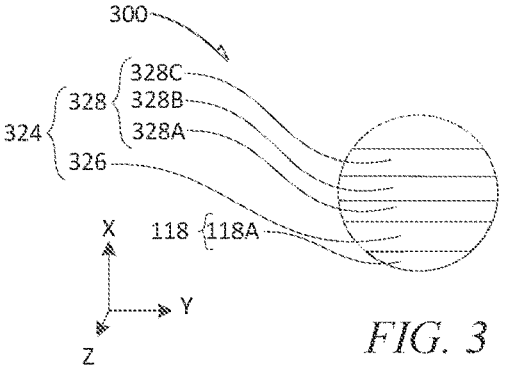
FIG. 3 is a detail section that is taken from a location indicated by the dashed circle illustrated in FIG. 1 in accordance with one or more embodiments of the disclosure.

FIG. 3 is a detail section that is taken from a location indicated by the dashed circle illustrated in FIG. 1 in accordance with one or more embodiments of the disclosure. A portion of a metal-coated article 300 is illustrated, including some of a refractory metal region 118 (see FIG. 1), including an unconverted refractory metal layer 118A. Further, a PGM coating region 324 includes a refractory metal/platinum-group metal layer 326, which is a transition between the refractory metal region 118 and the PGM coating region 324.

Still referring to FIG. 3, the PGM coating region 324 may be sequentially formed of more than one platinum-group metal, where the PGM coating region 328 may include, for example, two metals in three sequentially deposited layers, and where the refractory metal/platinum-group metal layer 326 may be at least partially a transition of a first-plated platinum-group metal of the PGM coating region 324. Consequently, the PGM coating region 324 may include a PGM layer 328A, a PGM layer 328B, and a PGM layer 328C above the PGM layer 328B.

Example 10: Still referring to FIG. 3, sequential electrochemical processing is formed over the refractory metal region 118, by forming three layers of platinum-group metals, with first platinum (Pt), followed by iridium (Ir), and lastly by repeating platinum (Pt), to form a PGM coating region 328. Consequently, the PGM coating region 324 includes a platinum (Pt) layer 328A, an iridium (Ir) layer 328B, and a platinum (Pt) layer 328C, where at least a portion of the Pt layer 328A forms the transition structure of the refractory metal/platinum-group metal layer 326.

Example 11: Still referring to FIG. 3, sequential electrochemical processing is formed over the refractory metal region 118, by forming three layers of platinum-group metals, with first iridium (Ir), followed by platinum (Pt), and lastly by repeating Ir to form a PGM coating region 328. Consequently, the PGM coating region 324 includes an iridium (Ir) layer 328A, a platinum (Pt) layer 328B, and a repeat iridium (Ir) layer 328C, where at least a portion of the Ir layer 328A forms the transition structure of the refractory metal/platinum-group metal layer 326.

Example 12: Still referring to FIG. 3, sequential electrochemical processing is formed over the refractory metal region 118, by forming three layers of platinum-group metals, with first platinum (Pt), followed by ruthenium (Ru), and lastly by repeating Pt to form a PGM coating region 328. Consequently, the PGM coating region 324 includes a platinum (Pt) layer 328A, a ruthenium (Ru) layer 328B, and a platinum (Pt) layer 328C, where at least a portion of the Pt layer 328A forms the transition structure of the refractory metal/platinum-group metal layer 326.

Example 13: Still referring to FIG. 3, sequential electrochemical processing is formed over the refractory metal region 118, by forming three layers of platinum-group metals, with first ruthenium (Ru), followed by platinum (Pt), and lastly by repeating Ru to form a PGM coating region 328. Consequently, the PGM coating region 328 includes a ruthenium (Ru) layer 328A, a platinum (Pt) layer 328B, and a ruthenium (Ru) layer 328C, where at least a portion of the Ru layer 328A forms the transition layer of the refractory metal/platinum-group metal layer 326.

Example 14: Still referring to FIG. 3, sequential electrochemical processing is formed over the refractory metal region 118, by forming three layers of platinum-group metals, with first ruthenium (Ru), followed by iridium (Ir), and lastly by repeating Ru to form a PGM coating region 328. Consequently, the PGM coating region 328 includes a ruthenium (Ru) layer 328A, an iridium (Ir) layer 328B, and a ruthenium (Ru) layer 328C, where at least a portion of the Ru layer 328A forms the transition layer of the refractory metal/platinum-group metal layer 326.

Example 15: Still referring to FIG. 3, sequential electrochemical processing is formed over the refractory metal region 118, by forming three layers of platinum-group metals, with first iridium (Ir), followed by ruthenium (Ru), and lastly by repeating Ir to form a PGM coating region 328. Consequently, the PGM coating region 328 includes an iridium (Ir) layer 328A, a ruthenium (Ru) layer 328B, and an iridium (Ir) layer 328C, where at least a portion of the Ir layer 328A forms the transition structure of the refractory metal/platinum-group metal layer 326.

For Examples 10-15, where adhesion of a pre-annealed refractory metal region 118 that includes the refractory metal precursor section 117 (e.g., FIG. 1) is sufficient to sustain subsequent formation of the PGM coating region 324, annealing may be done last, whereby the refractory metal carbide layer 120 may be formed.

Still referring to FIG. 3, the PGM coating region 324 may be sequentially formed of more than one platinum-group metal, where the PGM coating region 324 may include, for example, three different PGM metals sequentially deposited, and where the refractory metal/platinum-group metal layer (fourth structure) 326 may be at least partially a transition of a first-plated platinum-group metal.

Example 16: Still referring to FIG. 3, a sequential electrochemical processing is formed over the refractory metal region 118, by forming three layers of platinum-group metals, with first platinum (Pt), followed by iridium (Ir), and lastly by electrochemical processing ruthenium (Ru) to form a PGM coating region 328. Consequently, the PGM coating region 328 includes a platinum (Pt) layer 328A, an iridium (Ir) layer 328B, and a ruthenium (Ru) layer 328C, where at least a portion of the Pt fifth structure 328A forms the transition structure of the refractory metal/platinum-group metal layer 326.

Example 17: Still referring to FIG. 3, a sequential electrochemical processing is formed over the refractory metal region 118, by forming three layers of platinum-group metals, with first iridium (Ir), followed by ruthenium (Ru), and lastly by electrochemical processing platinum (Pt) to form a PGM coating region 328. Consequently, the PGM coating region 328 includes an iridium (Ir) layer 328A, a ruthenium (Ru) layer 328B, and a platinum (Pt) layer 328C, where at least a portion of the Ir layer 328A forms the transition structure of the refractory metal/platinum-group metal layer 326.

Example 18: Still referring to FIG. 3, a sequential electrochemical processing is formed over the refractory metal region 118, by forming three layers of platinum-group metals, with first ruthenium (Ru), followed by platinum (Pt), and lastly by electrochemical processing iridium (Ir) to form a PGM coating region 328. Consequently, the PGM coating region 328 includes a ruthenium (Ru) layer 328A, a platinum (Pt) layer 328B, and an iridium (Ir) layer 328C, where at least a portion of the Ru layer 328A forms the transition structure of the refractory metal/platinum-group metal layer 326.

Example 19: Still referring to FIG. 3, a sequential electrochemical processing is formed over the refractory metal region 118, by forming three layers of platinum-group metals, with first iridium (Ir), followed by platinum (Pt), and lastly by electrochemical processing ruthenium (Ru) to form a PGM coating region 328. Consequently, the PGM coating region 328 includes an iridium (Ir) layer 328A, a platinum (Pt) layer 328B, and a ruthenium (Ru) layer 328C, where at least a portion of the Ir fifth structure 328A forms the transition structure of the refractory metal/platinum-group metal layer 326.

Example 20: Still referring to FIG. 3, a sequential electrochemical processing is formed over the refractory metal region 118, by forming three layers of platinum-group metals, with first ruthenium (Ru), followed by iridium (Ir), and lastly by electrochemical processing platinum (Pt) to form a PGM coating region 328. Consequently, the PGM coating region 328 includes a ruthenium (Ru) layer 328A, an iridium (Ir) layer 328B, and a platinum (Pt) layer 328C, where at least a portion of the Ru fifth structure 328A forms the transition structure of the refractory metal/platinum-group metal layer 326.

Example 21: Still referring to FIG. 3, a sequential electrochemical processing is formed over the refractory metal region 118, by forming three layers of platinum-group metals, with first platinum (Pt), followed by ruthenium (Ru), and lastly followed by iridium (Ir), and lastly by electrochemical processing to form a PGM coating region 328. Consequently, the PGM coating region 328 includes a platinum (Pt) layer 328A, a ruthenium (Ru) layer 328B, and an iridium (Ir) layer 328C, where at least a portion of the Pt fifth structure 328A forms the transition structure of the refractory metal/platinum-group metal layer 326.

For Examples 16-21, where adhesion of a pre-annealed refractory metal region 118 that includes the refractory metal precursor section 117 (e.g., FIG. 1) is sufficient to sustain subsequent formation of the PGM coating region 324, annealing may be done last, whereby the refractory metal carbide layer 120 may be formed.

Figure 4:
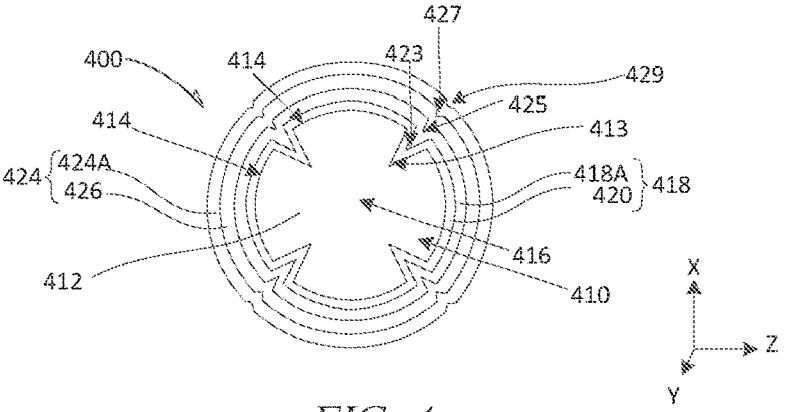
FIG. 4 is a simplified transverse cross-section view of a functionalized inert electrode, taken orthogonal to views depicted in FIGS. 1-3 in accordance with one or more embodiments of the disclosure.

FIG. 4 is a simplified transverse cross-section view of a functionalized inert electrode 400, in accordance with one or more embodiments of the disclosure. Whereas with respect to the metal-coated article 100 illustrated in FIG. 1, which has substantially linear (X-direction) surface locations 114, the illustrated functionalized inert electrode 400 has optional indentations 413 that interrupt otherwise curvilinear (Z-direction) structures of surface locations 414 of a body section first structure 412 (or BDD substrate structure 412) of a substrate 410, such as a boron-doped diamond (BDD) substrate 410. In some embodiments, the functionalized inert electrode 400 includes the BDD substrate 410, a refractory metal region 418, and a platinum-group metal coating region 424. Although the BDD substrate 410 may herein be referred to as a BDD substrate 410 or a BDD substrate region 410, one of the other enumerated materials may be used in place of a BDD substrate. Within the BDD substrate 410, a BDD substrate structure 412 comprises essentially all of the BDD substrate 410. Surface locations 414 on the BDD substrate structure 412, define substantially radial boundaries of the BDD substrate 410, with interrupted radial boundaries including indentations 413 within the BDD substrate structure 412 at the surface locations 414. In some embodiments, the BDD substrate structure 412 has a boron content selected from the group consisting of substantially uniformly distributed presence throughout the BDD substrate structure 412, superficially concentrated, closer to the surface locations 414, and more centrally concentrated closer to the centroid locations 416 than to the surface locations 414.

Still referring to FIG. 4, the functionalized inert electrode 400 includes the refractory metal region 418 substantially concentrically surrounding the BDD substrate 410, with at least one indentation 413 within the BDD substrate structure 412. The presence of the at least one indentation 413, increases the effective surface area of the BDD body section first structure 412, to which a refractory metal carbide section second structure 420 may adhere. In some embodiments where no indentations 413 would be present, and the circumference of the BDD body section first structure 412 would be a length of unity. With at least one indentation 413 present, however, the surface area presented to the refractory metal region 418 is in a range from 1.1 of unity to about 1.5 of unity.

The refractory metal region 418 includes the refractory metal carbide layer 420 that transitions to a refractory metal layer 418A. More generally in some embodiments, the refractory metal carbide layer 420 may be a refractory metal carbide layer 420. The refractory metal carbide layer 420 is adjacent the adjacent the BDD substrate structure 412 beginning at surface locations 414 and indentations 413.

Still referring to FIG. 4, formation of the two layers within the refractory metal region 418, includes first electrochemical processing a metal from a refractory metal functional electrolyte to form a preliminary refractory metal region (e.g., see the preliminary refractory metal precursor region 117 in FIG. 1). Thereafter, an annealing or heating act is done, where the heat-treatment act converts a portion of the plated refractory metal to, e.g., the refractory metal carbide layer 420, and leaving unreacted refractory metal material as the refractory metal layer 418A.

In some embodiments, the refractory metal carbide layer 420 has formed a functionalized bond to the BDD substrate structure 412 both at surface locations 414 and within indentation locations 413, such that physical integrity of the refractory metal carbide layer 420 is held above the BDD substrate structure 412 during usage such as molten salt deoxidation processing, where the metal-coated article is a functionalized inert anode 400. Consequently, and by contrast with the metal-coated article 100 illustrated in FIG. 1, a higher surface area ratio to total mass of the BDD substrate 410 is presented to allow the refractory metal carbide layer 420 to adhere at the surface locations 414 and indentions 413 to the BDD substrate structure 412 of the BDD substrate 410. Further, achievement of the refractory metal carbide layer 420, improves electrical conductivity when the metal-coated article 400 is used as a functionalized inert anode 400.

Still referring to FIG. 4, the functionalized inert anode 400 includes the platinum-group metal (PGM) coating region 424 concentrically surrounding the refractory metal region 418. In some embodiments, the PGM coating region 424 includes a platinum-group metal layer 424A above the refractory metal layer 418A. The PGM layer 424A may be an outer coating for the entire functionalized inert anode 400. In some embodiments, a refractory metal/platinum-group metal layer 426 is between and contacting at opposite boundaries, each of the platinum-group metal layer 424A and the refractory metal layer 418A. The refractory metal/platinum-group metal layer 426 is a metal-metal structure, and it is a transition between the refractory metal region 418 and the platinum-group metal coating region 424.

Still referring to FIG. 4, processing is done to form the platinum-group metal (PGM) coating region 424. In some embodiments, a platinum-group metal is dissolved in an alkali metal bromide melt and plated onto the refractory metal region 418 at the refractory metal layer 418A. Adhesion of the PGM coating region 424 to the refractory metal region 418, may be achieved under conditions to form a transition such as a refractory metal/platinum-group metal layer 426 on the refractory metal layer 418A, where materials from each layer are combined in a gradient therebetween. In each embodiment of the disclosure relating to FIG. 4, the indentations 413 may be reflected through subsequent layers, up to and including the PGM layer 424A, such as at residual indentations 429. Such residual indentations may include a refractory metal carbide layer residual indentation 423, a refractory metal layer residual indentation 425, a metal-metal refractory metal PGM transition indentation 427, and the PGM layer residual indentation 429.

In some embodiments, more than one platinum-group metal material may be sequentially formed to result in the PGM coating region 424, such as the illustrated embodiments depicted and described with respect to FIG. 2 where residual indentations up to the PGM section structure residual indentation 429 may also be present. Similarly in some embodiments, more than one platinum-group metal material may be sequentially formed to result in the PGM coating region 424, such as the illustrated embodiments depicted and described with respect to FIG. 3 where residual indentations 429 may also be present.

In some embodiments, coated articles such as any of the metal-coated articles 100, 200, 300 or 400 may be used in various applications. In some embodiments, the coated articles may be used as radiation-resistant sensors. In some embodiments, the coated articles may be used as sensors in molten salt thermophysical measurements. In some embodiments, the coated articles may be used as anodes for high-energy uses such as x-ray anodes. In some embodiments, the coated articles may be used as containment structures such as in hot fusion reactors.

Figure 5:
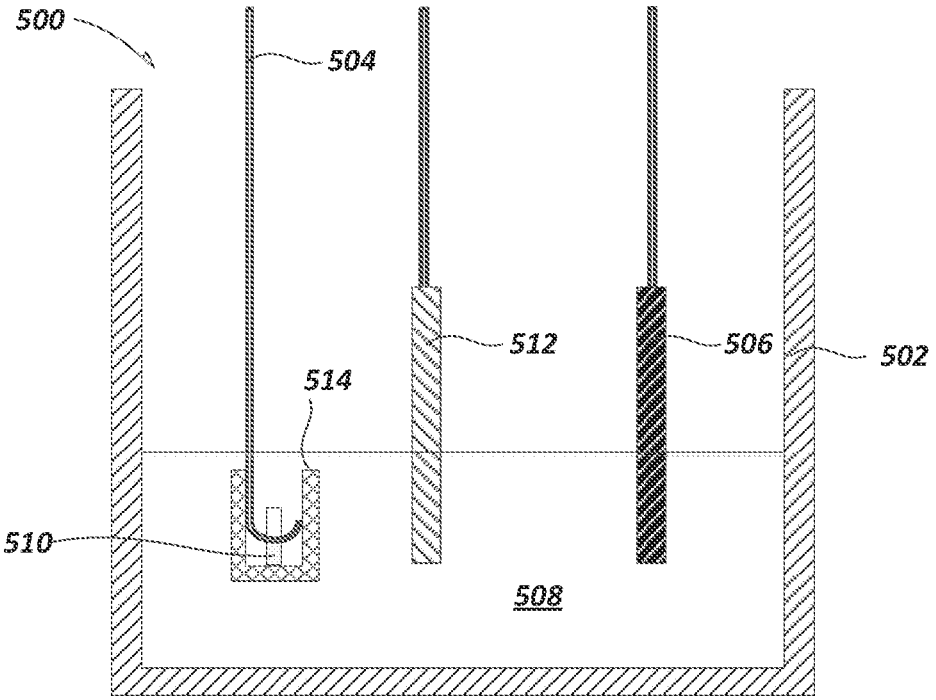
FIG. 5 is a simplified diagram of an electroplating system according to some embodiments of the disclosure.

FIG. 5 is a simplified diagram of an electrochemical processing system 500 according to some embodiments of the disclosure. In some embodiments, the electrochemical processing system 500 is used to form functionalized inert electrodes such as those shown in FIGS. 1-4. In some embodiments, an inert functional electrode embodiment is used to form selected metallic products, where the anode 506 is a functionalized electrode embodiment. In some embodiments of the disclosure, electrochemical chemical processing of the refractory metal region 118 (e.g., FIG. 1), followed by electroplating of the platinum-group metal region 124 (e.g., FIG. 1) is conducted in an electrochemical cell of the electrochemical processing system 500 that includes a crucible 502, a working electrode (also referred to as a cathode) 504, a counter electrode (also referred to as an anode) 506, an electrolyte (e.g., a molten alkali metal salt electrolyte 508), and a reference electrode 512. As shown in FIG. 5, the working cathode 504 may function as a substrate for metals dissolved in functional electrolytes to form materials such as the refractory metal region 118, (e.g., FIG. 1), and platinum-group metal region 124, (e.g., FIG. 1). In some embodiments of the disclosure, the materials to be plated to form each of the refractory metal region 118 and subsequently the platinum-group metal region 124, are supplied to the molten alkali metal salt electrolyte 508 as oxides of such metals.

Still referring to FIG. 5, the electrochemical cell of the electrochemical processing system 500 may be housed in an atmosphere-controlled environment such as a "glove box," such as an argon or helium-containing atmosphere glove box, to reduce exposure of sensitive components to moisture and/or oxygen. The crucible 502 is configured to contain the molten alkali metal salt electrolyte 508 and a basket 514 is configured to contain a substrate region 510 such as the BDD substrate 110 illustrated in FIG. 1. Cathodic reduction is done, first to form the refractory metal region 118 (e.g., FIG. 1) on the substrate region 510 and thereafter to form the platinum-group metal region 124 (e.g., FIG. 1) on the refractory metal region 118. Each of the working electrode 504, the counter electrode 506, and the reference electrode 512 is at least partially disposed in the molten alkali metal salt electrolyte 508 and in electrochemical contact with the molten alkali metal salt electrolyte 508. When an electrical potential is applied between the working electrode 504 and the counter electrode 506, the metal(s) to be plated onto the substrate region 510, may be chemically reduced in the electrochemical cell of the electrochemical processing system 500.

The molten alkali metal salt electrolyte 508 may be established at a temperature of from about 350° C. to about 500° C. when used to reduce the metal (s) and to plate the resulting metal(s) onto the substrate region 510 as it is coupled to the working electrode 504. Alternately, higher temperatures may be used, for example, up to about 950° C. In some embodiments, the molten alkali metal salt electrolyte 508 may be formulated to exhibit a melting temperature within a range of from about 350° C. to about 500° C., such as from about 350° C. to about 425° C., or from about 350° C. to about 450° C. The molten alkali metal salt electrolyte 508 may be maintained at a temperature such that the molten alkali metal salt electrolyte 508 is, and remains, in a molten state. In other words, the temperature of the metal(s) to be reduced and plated onto the substrate region 510, may be maintained at or above a melting temperature of the molten alkali metal salt electrolyte 508. However, the use of lower temperatures may be useful. For example, keeping the molten alkali metal salt electrolyte 508 at a lower temperature may utilize less energy.

For reducing the metal(s) and/or electrochemical processing the resulting metal(s) onto the substrate region 510 as it is coupled to the working electrode 504, the current density may be between about 150 Amp/ft$^2$ and about 300 Amp/ft$^2$. The current density may be between about 200 Amp/ft$^2$ and about 250 Amp/ft$^2$. The current density may also be adjusted based upon the remaining amount of metal(s) within the molten alkali metal salt electrolyte 508, as amounts decrease toward a depleted amount of the functional electrolyte metal(s) to be deposited. The current density may also be adjusted based upon the composition of the molten alkali metal salt electrolyte 508 and electrolysis temperature.

In other examples, agitation of the molten alkali metal salt electrolyte 508 may be conducted to make contact of unreacted metal(s) to be reduced and deposited onto the substrate region 510, with as-yet unreduced metal(s) so as to retain a quasi-batch stirred-tank reactor (BSTR) environment within the molten alkali metal salt electrolyte 508 and the remaining unplated metal(s). Useful agitation amounts may depend, in part, on the composition and viscosity of the molten alkali metal salt electrolyte 508 in a dynamically changing BSTR environment. In some embodiments, agitation may be done by external processes such as by inductive stirring. The quasi-batch stirred-tank reactor environment may be changed by feeding more of the metal(s) to be plated onto the substrate region 510 into the molten alkali metal salt electrolyte 508, as the metal(s) are reduced and depleted from an original amount charged to the basket 514.

The crucible 502 may be formed of and include a ceramic material (e.g., alumina, magnesia (MgO), boron nitride (BN)), graphite, or a metallic material (e.g., nickel, stainless steel, molybdenum, or an alloy of nickel including chromium and iron, such as INCONEL®, commercially available from Special Metals Corporation of New Hartford, New York).

The counter electrode 506 may be a coated article such as those illustrated in FIGS. 1, 2, 3 and 4. The counter electrode 506 may, alternatively, be a carbonaceous material or a non-carbonaceous material. The counter electrode 506 may be formed of and include one or more of graphite (e.g., high density graphite), a platinum-group metal (e.g., platinum, osmium, iridium, ruthenium, rhodium, and palladium), an oxygen evolving electrode, or another material. By way of example only, the counter electrode 506 may be formed of and include osmium, ruthenium, rhodium, iridium, palladium, platinum, silver, gold, lithium iridate ($LizIrO_3$), lithium ruthenate ($LizRuO_3$), a lithium rhodate ($LiRhO_2$, $LiRhO_3$), a lithium tin oxygen compound (e.g., $LizSnO_3$), a lithium manganese oxygen compound (e.g., $LizMnO_3$), calcium ruthenate ($CaRuO_3$), strontium ruthenium ternary compounds (e.g., $SrRuO_3$, $Sr_2RuO_3$, $Sr_2RuO_4$), $CaIrO_3$, strontium iridate (e.g., $SrIrO_3$, $SrIrO_4$, $Sr_2IrO_4$), calcium platinate ($CaPtO_3$), strontium platinate ($SrPtO_4$), magnesium ruthenate ($MgRuO_4$), magnesium iridate ($MgIrO_4$), sodium ruthenate ($NazRuO_4$), sodium iridate ($NazIrO_3$), potassium iridate ($K_2IrO_3$), or potassium ruthenate ($K_2RuO_4$). In some embodiments, the counter electrode 506 comprises graphite. In other embodiments, the counter electrode 506 comprises one or more platinum-group metals. If the counter electrode 506 comprises iridium or ruthenium, the methods according to embodiments of the disclosure may be substantially non-polluting. In some embodiments, the counter electrode 506 comprises one or more platinum-group metals (e.g., ruthenium, rhodium, palladium, osmium, iridium, and platinum), and one or more transition metals. In some embodiments, the counter electrode 506 may be an inert anode embodiment, such as any metal-coated article 100, 200, 300, or 400 as described and illustrated.

The reference electrode 512 may comprise any suitable material and is configured for monitoring a potential in the electrochemical cell of the electrochemical processing system 500. In some embodiments, the reference electrode 512 comprises glassy carbon. The reference electrode 512, may be in electrical communication with the counter electrode 506 and the working electrode 504 and may be configured to assist in monitoring the potential difference between the counter electrode 506 and the working electrode 504. Accordingly, the reference electrode 512 may be configured to monitor the cell potential of the electrochemical cell of the electrochemical processing system 500. The reference electrode 512 may include nickel, nickel/nickel oxide, glassy carbon, silver/silver chloride, one or more platinum-group metals, one or more precious metals (e.g., gold), or combinations thereof. In some embodiments, the reference electrode 512 comprises glassy carbon. In other embodiments, the reference electrode 512 comprises nickel, nickel oxide, or a combination thereof. In yet other embodiments, the reference electrode 512 comprises silver/silver chloride.

A potentiostat or a DC power supply (not illustrated) may be electrically coupled to each of the reference electrode 512, the working electrode 504, and the counter electrode 506. The potentiostat may be configured to measure and/or provide an electric potential between the counter electrode 506 and the working electrode 504. The difference between the electric potential of the counter electrode 506 and the electric potential of the working electrode 504 may be referred to as a cell potential of the electrochemical cell of the electrochemical processing system 500.

Figure 6:
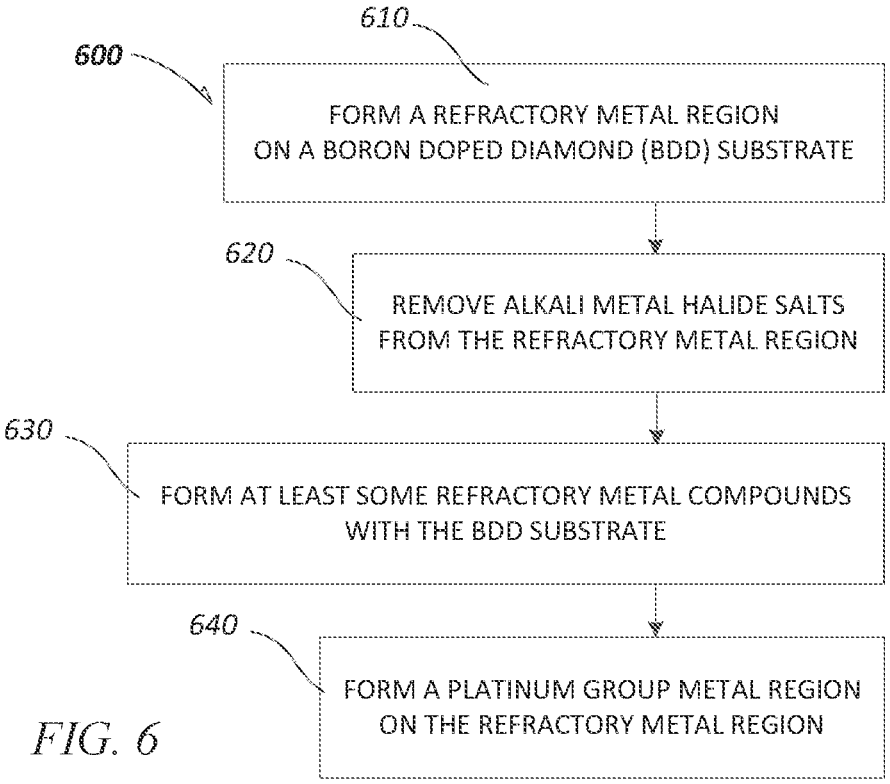
FIG. 6 is a process flow diagram for forming a coated article, including a refractory metal region on a boron-doped diamond substrate, and a platinum-group metal region on the refractory metal region according to some embodiments of the disclosure.

FIG. 6 is a simplified process flow diagram 600 that illustrates a method of forming an inert functional electrode according to embodiments of the disclosure. The functional electrolyte functions as a source of the metal or metals to be deposited as the plated metal regions, including first using a refractory metal functional electrolyte, and after forming the refractory metal region, second using a platinum-group metal functional electrolyte to form the platinum-group metal region. The auxiliary electrolytes provide both a thermodynamic and kinetic chemical pathway, through which the metals in the functional electrolytes may pass to be deposited upon a cathode of an electrode assembly. The auxiliary electrolyte and the functional electrolytes are used as halide electrolyte components of a salt melt, which may be referred to as a molten salt electrochemical processing bath during electrochemical processing conditions. The disclosed method is relatively inexpensive, simple, and formulated to deposit metals and metal alloy onto simple or complex geometry substrates, allows for ready control of film thickness, avoids oxygen contamination particularly in the substrate structures, and uses post-coating treatments. The disclosed method offers uniform surface coverage, is effectuated at a relatively low temperature compared with conventional physical and chemical vapor deposition techniques, uses economical salts as feedstocks, uses inexpensive equipment, and is readily scalable.

Prior to electrochemical processing, the thermally conductive substrate to be plated, such as the BDD body region 110 (e.g., FIG. 1) is cleaned and then attached (e.g., electrically connected) to the working electrode (e.g., the cathode) of the electrode assembly and placed in the molten salt electrochemical processing bath. Current from a power source is applied to the cathode to produce a negative charge on the cathode. The negative charge combines with the positively charged metal ions in the molten salt electrochemical processing bath to form the plated metal from the salt melt onto the thermally conductive substrate. The current may be applied for from about 30 minutes to about 120 minutes, although other times may be used depending on the desired thickness of the plated metal. Longer times are associated with thicker electrochemical processing on the substrate. The thickness of the plating may be proportional to the electrochemical processing time.

Electrochemical processing of metals dissolved in the auxiliary electrolyte, include first electrochemical processing the refractory metal from the refractory metal functional electrolyte onto the thermally conductive substrate, followed by, after some other processing including rinsing the refractory metal region and annealing, second electrochemical processing the platinum-group metal from the platinum-group metal functional electrolyte. In some embodiments, the two electrochemical processing processes may be done using a single vessel. In some embodiments, the two electrochemical processing processes may be done using separate vessels: the first vessel containing a selected auxiliary electrolyte with the refractory metal functional electrolyte, and the second vessel containing a selected auxiliary electrolyte with the platinum-group metal functional electrolyte. Between first forming the refractory metal and forming the platinum-group metal, rinsing the refractory metal region and the anneal process may be done to form refractory metal compounds with materials from the substrate.

At 610, the method includes forming a refractory metal region on a substrate, such as forming the refractory metal region 118 (FIG. 1) on the BDD substrate 110. In some embodiments, forming the refractory metal region includes using a molten salt melt with an auxiliary electrolyte such as cesium bromide, to form a thermodynamic and kinetic deposition pathway to deposit a refractory metal from the functional electrolyte onto the substrate.

At 620, the method includes removing halide salts from the refractory metal region. In a non-limiting example embodiment, the body section first structure 112 (e.g., FIG. 1) has been plated with a refractory metal region 118, and an intermediate structure is removed from the salt melt and rinsed under conditions to remove any unplated functional electrolyte of refractory metal, as well as any auxiliary electrolyte. In some embodiments, "rinsing" may be done with pre-heated gases that are inert to further reacting with the refractory metal region. The pre-heated inert gases may use heat energy derived from the molten salt electrochemical processing bath.

At 630, the method includes forming at least some refractory metal compounds with the body section first structure by heat treating such as by an annealing act. In some embodiments, the anneal conditions anneal conditions include a temperature range from about 500° C. to about 600° C., for a time period from about 1 hour to about 12 hours, and in an inert-gas environment such as with helium (He) or argon (Ar). As a result of the anneal process, at least half of the mass of the refractory metal region 118 (e.g., FIG. 1) is converted to a refractory metal compound such as a refractory metal carbide when the substrate 110 (e.g., FIG. 1) is a BDD substrate 110. Where the body section first structure 112 (e.g., FIG. 1) is a BDD material, a refractory metal carbide layer 120 forms by carbiding some of the refractory metal from the BDD material of the body section first structure 112.

At act 640, the method includes forming a platinum-group metal region on the refractory metal region. In a non-limiting example embodiment, an alkali halide salt melt that includes the alkali halide as the auxiliary electrolyte, is used to melt a PGM containing functional electrolyte, and, e.g., iridium is plated onto the refractory metal region 118 to form the PGM coating region 124 (e.g., FIG. 1).

In some embodiments, a second annealing is done to form the refractory metal/platinum-group metal layer (fourth structure) 126 (e.g., FIG. 1). In some embodiments, any of the Example embodiments 1, 2, or 3 is conducted to form the PGM coating region 124.

Still referring to act 640, in some embodiments, multiple PGM materials may be formed above the refractory metal region 118 (e.g., FIGS. 1 and 2). In some embodiments, any of the Example embodiments 4, 5, 6, 7, 8 or 9 is conducted to form the PGM coating region 224.

Still referring to act 640, in some embodiments, multiple PGM materials are formed above the refractory metal region 118 (e.g., FIGS. 1 and 3). In some embodiments, any of the Example embodiments 10, 11, 12, 13, 14, 15, 16, 17, 18, 19, 20 or 21 is conducted to form the PGM coating region 324.

In some embodiments, only one side of the body section first structure 112 is plated for use as a reactor wall in a molten salt reactor (MSR), such as a thorium $^{232}$Th conversion to $^{233}$Pr and ultimately to $^{233}$U, which is a fissile material for energy production. In some embodiments, only one side of the body section first structure 112 is plated for use as a reactor wall in an MSR for primary production of metallic materials. In some embodiments, only one side of the body section first structure 112 is plated for use as a reactor wall in an MSR for recycling waste engineering materials, such as recovering superalloys including refractory and platinum-group metals. In some embodiments, only one side of the body section first structure 112 is plated for use as a reactor wall in an MSR for processing unused nuclear fuel such as fuel rods in water-cooled nuclear energy processes.

Example 22: Use of an inert functionalized anode, such as any of the functionalized inert electrode structures 100, 200, 300, or 400, is used in a salt melt process, to form a binary metal that is reduced from an ilmenite concentrate ($FeO{\cdot}TiO_2$) to form an FeTi alloy. A concentrate of ilmenite, which may be represented as $FeO{\cdot}TiO_2$, is submitted to a molten salt electrolytic cell such as the molten salt electrolytic cell of the electrochemical processing system 500 illustrated in FIG. 5. An inert anode 506 such as any of the metal-coated article embodiments 100, 200, 300, and 400 depicted herein, e.g., the metal-coated article 100 illustrated in FIG. 1, and processing removes the oxygen in the ilmenite concentrate to achieve an FeTi alloy that plates onto the working cathode such as onto the substrate region 510 that is connected to a working cathode 504 (FIG. 5). Such co-deposited FeTi alloys may be useful for specific applications. Under a voltage potential and current through the molten salt electrolyte, oxygen is liberated from the dissolved $FeO{\cdot}TiO_2$, and make-up inert atmosphere is added, while a bleed stream is substantially matched to amounts of the make-up inert atmosphere.

Although the foregoing descriptions contain many specifics, these are not to be construed as limiting the scope of the disclosure, but merely as providing certain exemplary embodiments. Similarly, other embodiments of the disclosure may be devised that do not depart from the scope of the disclosure. For example, features described herein with reference to one embodiment may also be provided in others of the embodiments described herein. The scope of the embodiments of the disclosure is, therefore, indicated and limited only by the appended claims and their legal equivalents, rather than by the foregoing description. All additions, deletions, and modifications to the disclosure, as disclosed herein, which fall within the meaning and scope of the claims, are encompassed by the disclosure.

What is claimed is:

1. A metal coated article, comprising:

a substrate comprising an inorganic material;

a refractory metal region adjacent the substrate, the refractory metal region comprising:

a refractory metal carbide layer adjacent the substrate; and a refractory metal layer adjacent the refractory metal carbide layer; and a platinum-group metal region adjacent the refractory metal region, the platinum-group metal region comprising:

a refractory metal/platinum-group metal layer adjacent the refractory metal layer; and a platinum-group metal layer adjacent the refractory metal/platinum-group metal layer, the platinum-group metal layer comprising:

one or more of iridium and ruthenium; or platinum and one or more of iridium and ruthenium.

2. The metal coated article of claim 1, wherein the substrate comprises a boron-doped diamond material.

3. The metal coated article of claim 1, wherein the refractory metal carbide layer directly contacts the substrate and the refractory metal layer.

4. The metal coated article of claim 1, wherein the refractory metal/platinum-group metal layer directly contacts the refractory metal layer and the platinum-group metal layer.

5. The metal coated article of claim 1, wherein the substrate comprises a boron-doped diamond material, a molybdenum disilicide material, a graphite material, a lanthanum chromite-based material, a perovskite material, or a titanium oxide material.

6. The metal coated article of claim 1, wherein the refractory metal layer comprises tungsten, molybdenum, vanadium, titanium, or a combination thereof.

7. The metal coated article of claim 1, wherein the refractory metal carbide layer comprises tungsten carbide, molybdenum carbide, vanadium carbide, titanium carbide, or a combination thereof.

8. The metal coated article of claim 1, wherein the platinum-group metal layer comprises two or more layers of platinum-group metals.

9. The metal coated article of claim 1, wherein the platinum-group metal layer comprises three or more layers of platinum-group metals.

10. The metal coated article of claim 9, wherein one or more layers of the three or more layers of platinum-group metals comprises a different platinum-group metal.

11. The metal coated article of claim 8, wherein two layers of the three or more layers of platinum-group metals comprise the same platinum-group metal.

12. The metal coated article of claim 1, wherein the platinum-group metal region is bonded to the refractory metal region.

13. A method of forming a metal coated article, comprising:

forming a refractory metal region adjacent a substrate comprising an inorganic material, wherein forming the refractory metal region comprises:

depositing a refractory metal from a functional electrolyte in an alkali halide auxiliary electrolyte bath, onto the substrate to form a refractory metal layer; and converting a portion of the refractory metal layer to a refractory metal carbide layer, while a portion of the refractory metal layer remains an unreacted refractory metal, the refractory metal layer adjacent the refractory metal carbide layer and the refractory metal carbide layer adjacent the substrate;

forming a platinum-group metal region adjacent the refractory metal region, wherein forming the platinum-group metal region comprises:

depositing a platinum-group metal from the functional electrolyte in an alkali halide auxiliary electrolyte bath, onto the refractory metal layer to form a platinum-group metal layer comprising:

one or more of iridium and ruthenium; or platinum and one or more of iridium and ruthenium; and converting a portion of the platinum-group metal layer to a refractory metal/platinum-group metal layer adjacent the refractory metal layer, the platinum-group metal layer adjacent the refractory metal/platinum-group metal layer and comprising an exterior coating of the metal coated article.

14. The method of claim 13, wherein forming the refractory metal region comprises depositing from a functional electrolyte, a layer of tungsten, molybdenum, titanium, vanadium, or a combination thereof.

15. The method of claim 13, wherein converting a portion of the refractory metal layer to a refractory metal carbide layer comprises annealing the substrate and the refractory metal layer at a temperature from about 500° C. to about 600° C., for a time period range from about 1 hour to about 12 hours, and in an inert-gas environment.

16. The method of claim 13, wherein converting a portion of the refractory metal layer to a refractory metal carbide layer comprises annealing the substrate after forming the platinum-group metal region, wherein the refractory metal/platinum-group metal layer forms adjacent the refractory metal layer.

17. The method of claim 13, wherein forming the refractory metal region comprises depositing the refractory metal layer from the functional electrolyte at a temperature in a range of about 350° C. to about 500° C.

18. The method of claim 17, wherein forming the platinum-group metal region comprises depositing the refractory metal layer from the functional electrolyte at a temperature in a range of about 350° C. to about 500° C.

19. The metal coated article of claim 1, wherein the refractory metal region exhibits a thickness in a range of from about 10 micrometers to about 20 micrometers.

20. The metal coated article of claim 1, wherein the refractory metal carbide layer exhibits a greater thickness than a thickness of the refractory metal layer by a ratio of about 3:1.

* * * * *